US005453572A

United States Patent [19]

Kobayashi et al.

[11] Patent Number: 5,453,572

[45] Date of Patent: Sep. 26, 1995

[54] DOCKING WATERCRAFT

[75] Inventors: Noboru Kobayashi; Toshiyuki Hattori, both of Iwata, Japan

[73] Assignee: Yamaha Hatsudoki Kabushiki Kaisha, Iwata, Japan

[21] Appl. No.: 255,117

[22] Filed: Jun. 7, 1994

Related U.S. Application Data

[63] Continuation of Ser. No. 952,306, Sep. 28, 1992, abandoned, which is a continuation-in-part of Ser. No. 722,599, Jun. 27, 1991, abandoned.

[30] Foreign Application Priority Data

Jul. 2, 1990 [JP] Japan ..... 2-175592
Sep. 27, 1991 [JP] Japan ..... 3-249640

[51] Int. Cl.[6] ..... B63B 21/56

[52] U.S. Cl. ..... 114/248; 114/242

[58] Field of Search ..... 114/242, 246, 114/248–252, 44, 45, 48, 56, 61; 440/6, 38–47; 280/33.991, 33.992, 33.995, 33.996, 33.997

[56] References Cited

U.S. PATENT DOCUMENTS

| | | | |
|---|---|---|---|
| 3,347,201 | 10/1967 | Szabo | 114/248 |
| 3,659,546 | 5/1972 | Miklos | 114/248 |
| 3,815,541 | 6/1974 | Hansen | 114/248 |
| 3,858,541 | 1/1975 | Metcalf | 114/248 |
| 4,437,841 | 3/1984 | Stallman | 440/38 |
| 5,022,987 | 6/1991 | Wells | 440/6 |

FOREIGN PATENT DOCUMENTS

| | | |
|---|---|---|
| 63-119198 | 8/1988 | Japan . |
| 2046689 | 11/1980 | United Kingdom . |

OTHER PUBLICATIONS

Patent Abstract of Japany, vol. 14, No. 174, (M–959) ]4117], 5th Apr. 1990; and JP–A–2 28 088 (Yanmar Diesel Ltd.) 30 Jan. 1990; Translations of Japanese Apps. 63–119198 and 2–28088, publication—"The Party Shark"—The Ultimate Jet Ski Accessory.

*Primary Examiner*—Robert J. Oberleitner
*Assistant Examiner*—Clifford T. Bartz
*Attorney, Agent, or Firm*—Knobbe, Martens, Olson & Bear

[57] ABSTRACT

A berthing type of watercraft having a main hull that is devoid of any propulsion unit and which defines a passenger compartment to receive a plurality of passengers and a berthing area to receive a smaller watercraft having a propulsion device for powering the watercraft when received in the berthing area. There is provided a pair of storage compartments on the opposite sides of the berthing area where riders may sit with their feet in the berthing area. A detachable table can be stored in a storage compartment on one side of the berthing area for use by the seated riders. A bridge also extends over the rear portion of the berthing area and provides an arrangemen for lifting the rear of the small watercraft out of the water. In addition, a canopy may be attached to the bridge to afford protection for the berthing area and the passengers' area.

22 Claims, 8 Drawing Sheets

DOCKING WATERCRAFT

CROSS REFERENCE TO RELATED APPLICATION

This application is a continuation of our application of the same title, application Ser. No. 07/952,306, filed Sept. 28, 1992, now abandoned, which application was a continuation-in-part of our application of the same title, application Ser. No. 07/722,599, filed Jun. 27, 1991, now abandoned.

BACKGROUND OF THE INVENTION

This invention to relates to a docking watercraft and more particularly to several improvements in a docking type of watercraft.

As noted in the aforenoted co-pending application, there are a large variety of small personal type watercraft that are designed primarily to be operated by a single rider with the possibility of carrying only one or a few passengers. Frequently these small watercraft are powered by water jet propulsion units. However, the applicability and utility of such small personal watercraft is relatively limited due to the limited number of passengers which can be accommodated.

Because of these problems and to afford more utility for such small watercraft, a number of types of docking watercraft are disclosed in our earlier application wherein there is provided a main watercraft having a main hull with a berthing area into which the smaller watercraft may be driven. The main hull is provided with no power unit of its own but is designed so as to be operated by the propulsion unit of the small watercraft when in the berthing area. As a result, a great utility for the use of the small watercraft can be accomplished through the use of the larger docking watercraft.

It is a purpose of this invention to provide several improvements for the watercraft of this type. For example, in the co-pending application the passengers' area is generally open, although one embodiment discloses a removableumbrella that may be employed as a cover. However, in many instances it may be desirable to provide a further cover for the passengers' compartment and it is one object of this invention to provide such a further cover.

In addition, with certain types of small watercraft, it is more convenient to operate the larger unpropelled watercraft by an operator still positioned on the smaller watercraft. When this is done, there are several reasons why it may be desirable to provide a bridge over the docking area and it is a further object of this invention to provide such a construction.

In the co-pending application there is also disclosed an embodiment wherein there is a removable cover that may be positioned over the berthing area. This cover may also be used as a table. With the seating arrangement in the prior application, however, the occupants of the seat must use the table somewhat in a sideways fashion. That is, the passengers sit in a fore and aft direction while the table will be positioned to their side rather than between as may be desirable in some instances.

It is, therefore, a still further object of this invention to provide an improved table arrangement for this type of watercraft wherein the passengers may be seated at the table in a normal fashion.

As noted above, the type of small watercraft utilized in conjunction with the larger docking watercraft having the berthing area are frequently propelled by jet propulsion units. When the jet propelled watercraft is not being operated, there are advantages of lifting it out of the body of water in which it is operating. At least, it is desirable to raise the watercraft sufficiently so that all water will drain out of the jet propulsion unit. This insures against incrustation of the jet propulsion unit during long periods of disuse. It also permits foreign objects to be removed from the water inlet of the smaller watercraft.

It is, therefore, a still further object of this invention to provide an improved arrangement wherein a jet propelled small watercraft may be raised out of the water when at least partially in the berthing area of the larger, normally unpropelled watercraft.

SUMMARY OF THE INVENTION

The features of this invention are all adapted to be embodied in a watercraft having a main hull that defines a passenger compartment and a berthing area that is adapted to receive a smaller watercraft having a propulsion unit. The main hull is devoid of a propulsion device and the berthing area is configured and arranged for propulsion of the main hull by the smaller watercraft propulsion unit when received in the berthing area.

In accordance with one feature of the invention, a bridge on the main watercraft extends at least in part over the berthing area.

In accordance with another feature of the invention, hoist means are provided on the main hull for lifting at least a portion of the smaller watercraft out of the water when at least partially in the berthing area.

In accordance with another feature of the invention, the main hull is provided with means on at least side of the berthing area upon which a rider may sit with his feet extending to the berthing area. A detachable table is adapted to be affixed across the berthing area and above the legs of the rider seated on the one side.

DETAILED DESCRIPTION OF THE PREFERRED EMBODIMENTS OF THE INVENTION

Figure 1:
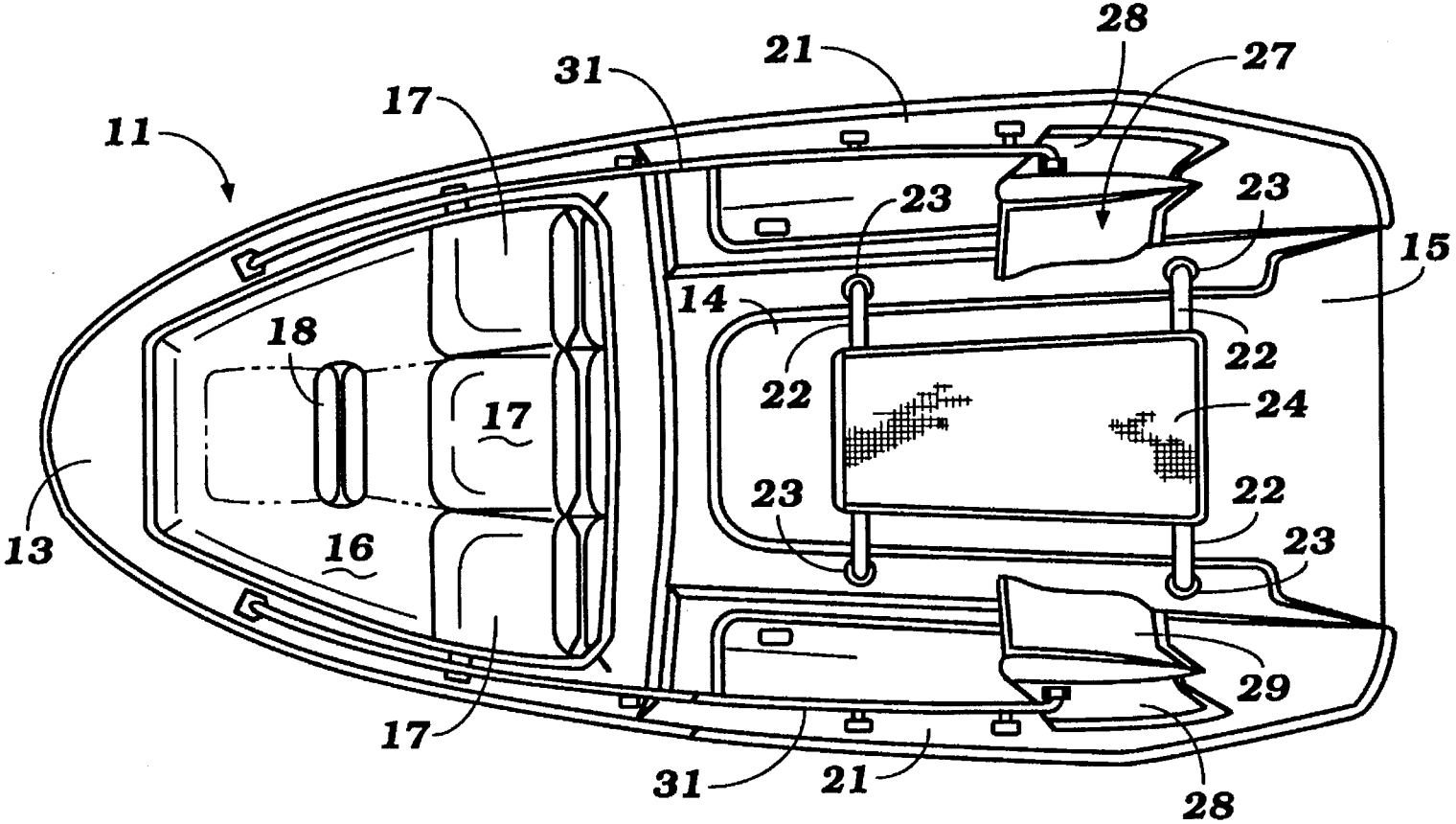
FIG. 1 is a top plan view of a docking watercraft constructed in accordance with an embodiment of the invention, with a portion broken away and with the optional table in place and without a smaller watercraft in the berthing area.
Figure 2:
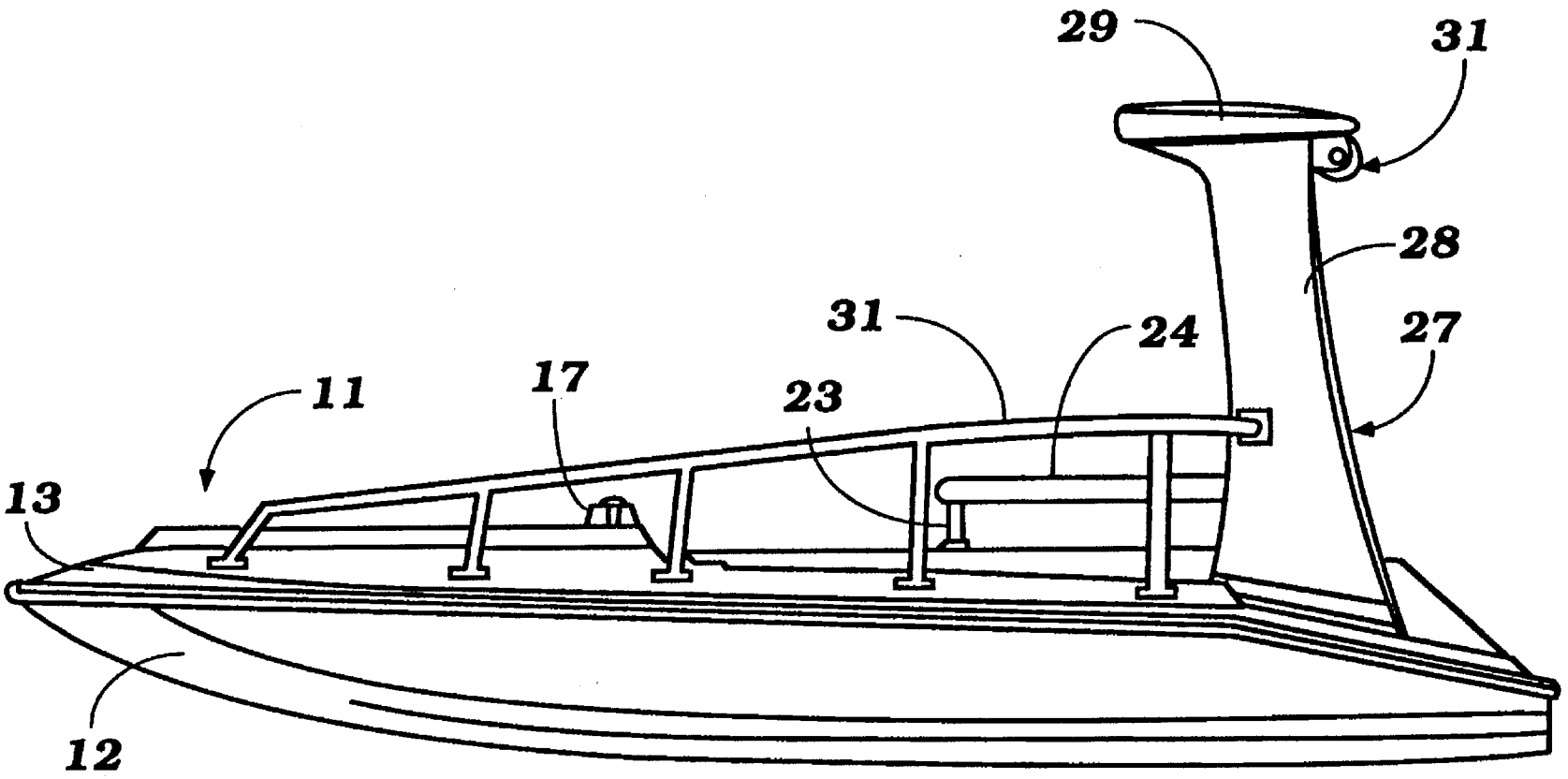
FIG. 2 is a side elevational view of the watercraft of this embodiment as shown in the condition described.

Referring now in detail to the drawings and initially to FIGS. 1 through 5, a docking watercraft constructed in accordance with an embodiment of the invention and depicted in a first configuration is identified generally by the reference numeral 11. The docking watercraft 11 is comprised of a main hull consisting of a lower hull portion 12 and a upper deck portion 13 which may be formed from a suitable material such as a molded fiberglass reinforced resinous plastic or the like. The hull portion 12 and deck portion 13 are secured to each other in any suitable manner.

In the illustrated embodiment, the main hull of the watercraft 11 is devoid of any power plant of its own but is formed witha berthing area, indicated generally by the reference numeral 14 at its rear portion. The docking area 14 may have a configuration as set forth in any of the embodiments described in aforementioned application Ser. No. 722,599 and is configured so as to dockingly receive a small watercraft of the jet propelled type in the berthing area 14. As described in the aforenoted co-pending application, the small watercraft contained within the berthing area 14 is of the jet propelled type and has itself a hull with a downwardly facing water inlet opening through which water for the jet propulsion unit is drawn.

Figure 6:
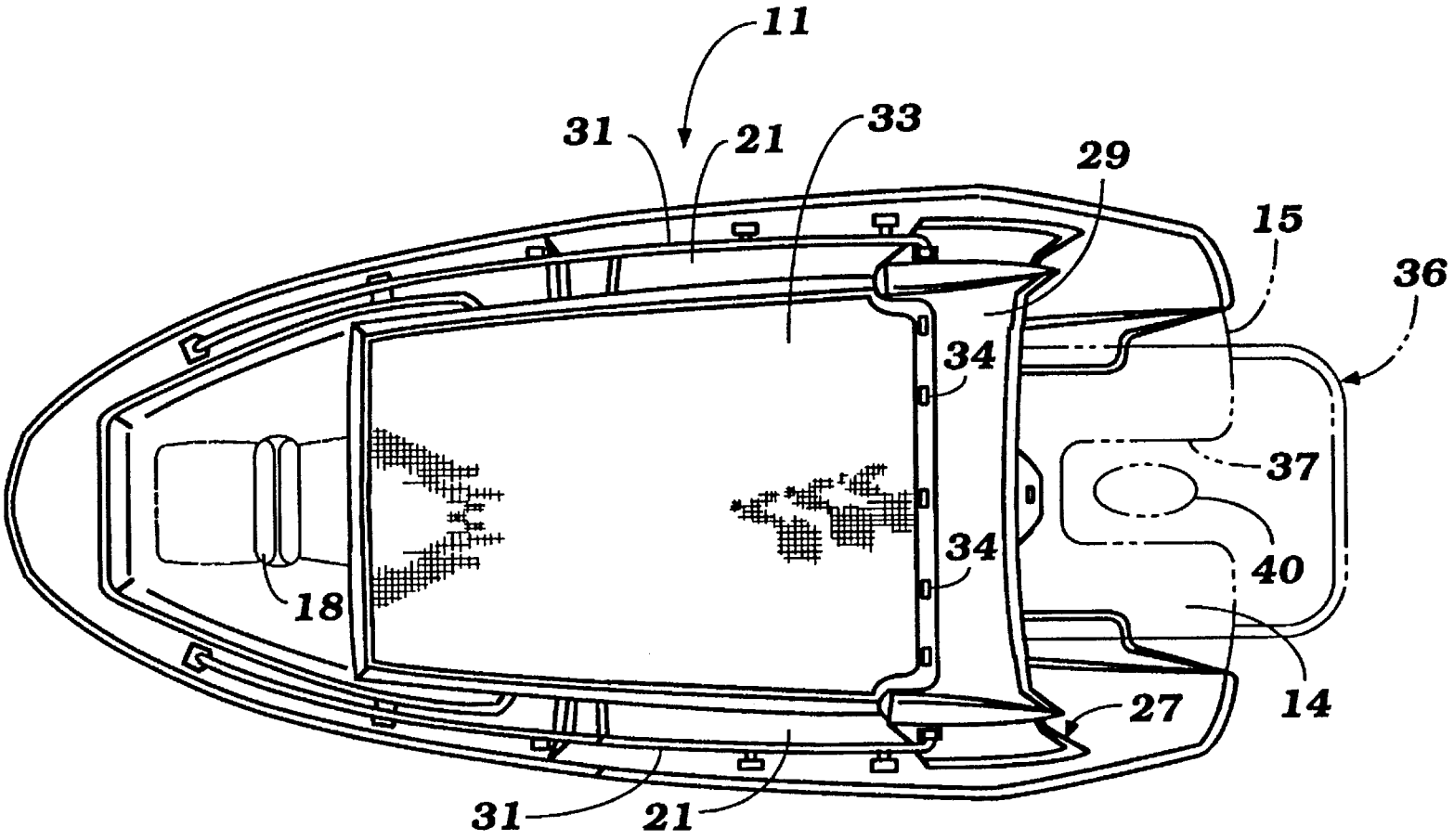
FIG. 6 is a top plan view, in part similar to FIG. 1, showing another accessory which can be used with the watercraft or another embodiment of the watercraft. In this figure, the smaller watercraft is shown partially in phantom.

In accordance with the invention, the berthing area 14 is formed in part by a partial lower wall 15 which is configured with a cutout or opening that is adapted to mate with or be slightly larger than the water inlet opening of the smaller propelled watercraft so that water may be easily drawn from the body of water in which the watercrafts are operating so that the main hull 11 may be propelled by the smaller watercraft. A construction of this type is shown in FIG. 6. The front of the berthing area 14 is formed with a suitable configuration so as to interlock with the bow of the small watercraft to hold it in place. In addition, some form of hold down mechanism (not shown) may be provided so as to hold the rear portion of the smaller watercraft in position so that its water inlet opening registers and seals with the water inlet opening of the lower wall 15.

In accordance with the illustrated embodiment of the invention, there is provided a passenger compartment 16 that is formed forwardly of the berthing area 14 and which, in the illustrated embodiment, contains three seats 17 which are positioned in side by side fashion and a forward seat 18. The seats 17 and 18 have foldable seat portions and backrests so that seats 17 and 18 may be configured either in an upright seating position as shown in FIG. 1 or may be folded down to form a cushion or sleeping area. Of course, various other arrangements may be provided.

To the rear of the passenger compartment 16 there are provided a pair of storage areas 19 that extend on opposite sides of the berthing area 14 (FIG. 5) and which are covered by removable seat portions 21 so as to afford access to their hollow interior. In accordance with a feature of the invention, the compartments 19 or one of them may contain a knock down type of table assembly that is comprised of a pair of "U" shaped bars 22 which are adapted to extend across the opposite sides of the berthing area 14 and be received in suitable sockets 23 formed at spaced locations along the storage areas 19. This construction is best shown also in FIG. 5 but also appears in FIGS. 1 and 3.

Figure 3:
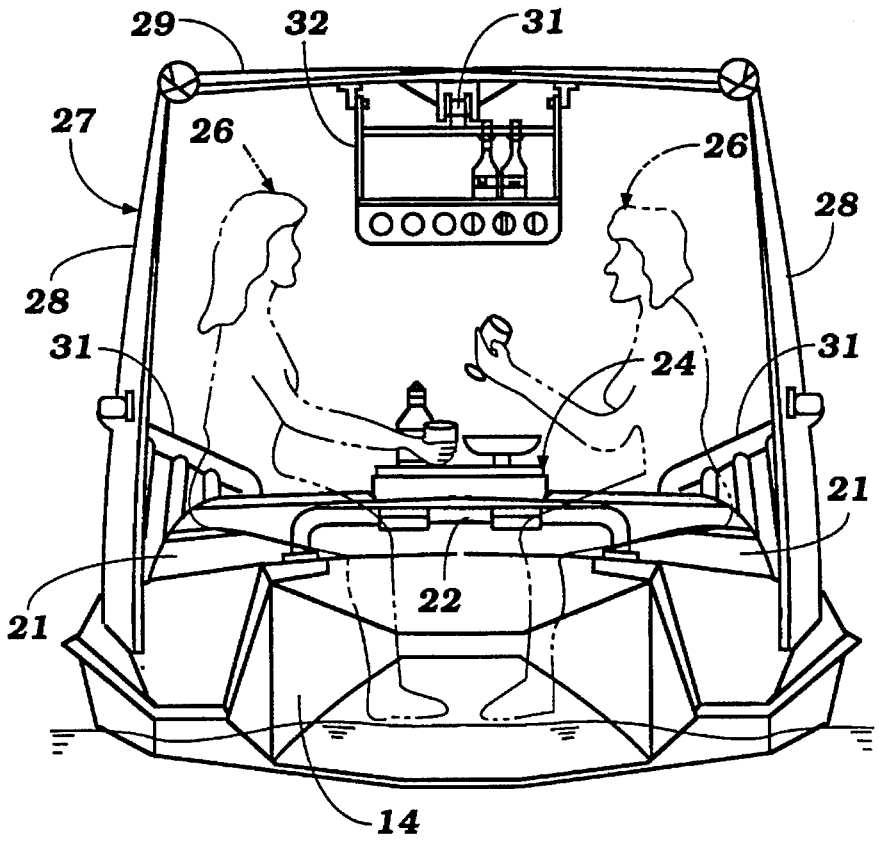
FIG. 3 is a rear elevational view showing how the table can be employed.
Figure 4:
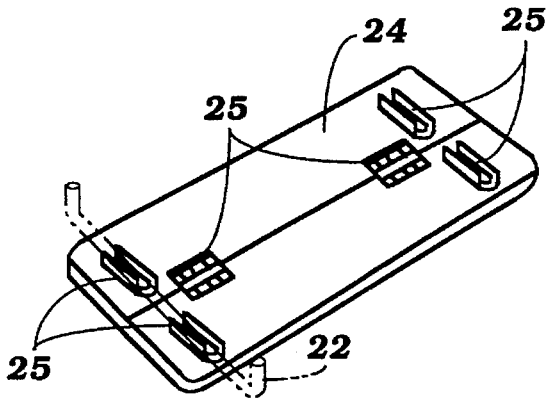
FIG. 4 is a bottom perspective view of the table and shows in phantom how it is attached to the supporting rail.
Figure 5:
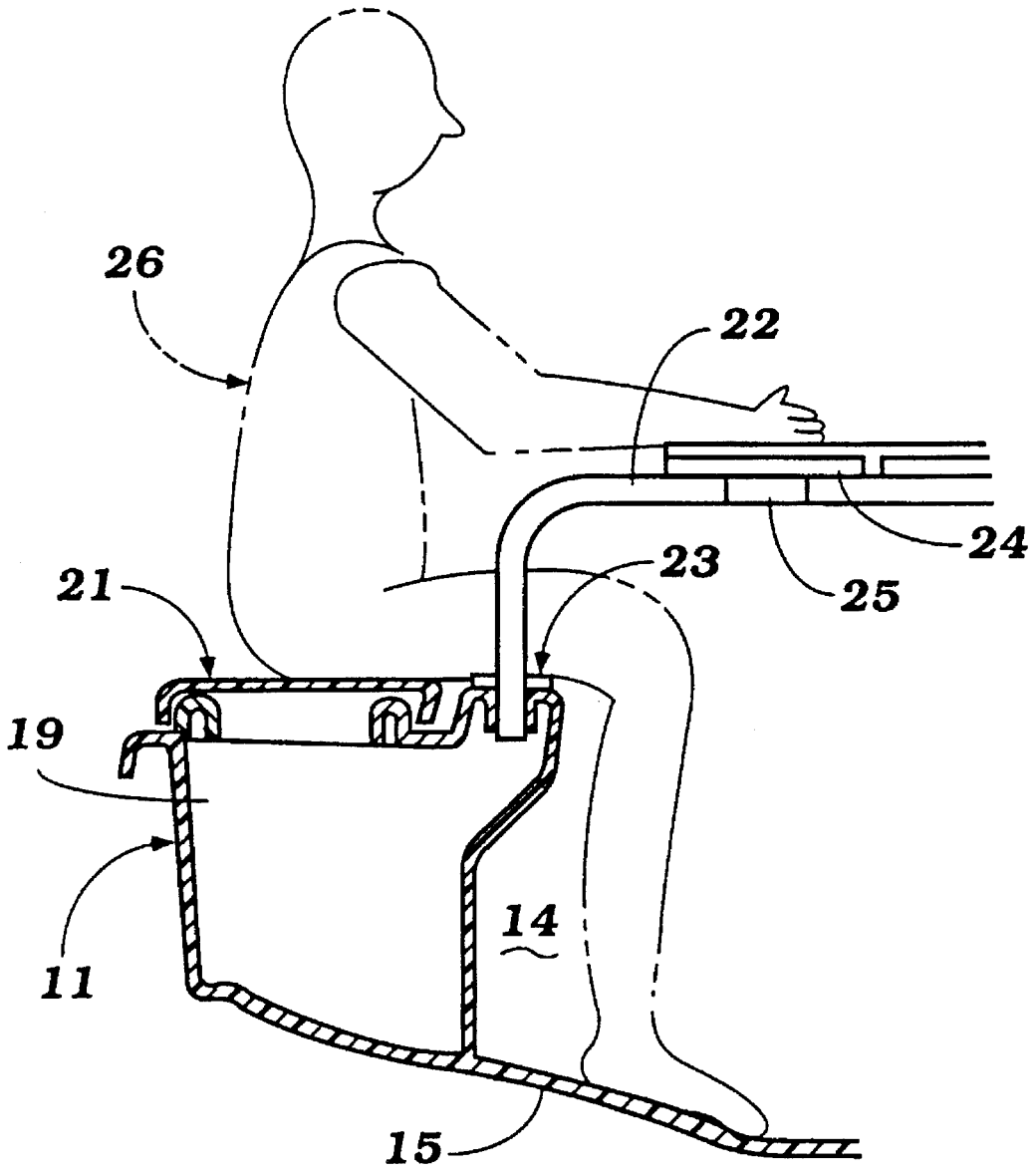
FIG. 5 is a further enlarged cross sectional view showing how the table is attached to the watercraft and how a user may be seated at the table.

The "U" shaped bars 22 are adapted to receive a folding table, as best shown in FIG. 4 and which is identified generally by the reference numeral 24. The table 24 is comprised of two halves that are hinged together by hinges 25 so that it may be conveniently folded into one of the storage areas 19 when the respective cover 21 is removed. Pairs of snap type fasteners 25 are carried on the underside of the table halves and are adapted to be detachably connected to the "U" shape bars 22 for maintaining the table 24 in its erected position as shown in FIGS. 3 and 5. In this position, riders, shown in phantom and identified by the reference numeral 26 may be seated on the covers 21 and place their legs into the berthing area 24 when the small watercraft is not positioned therein. Thus, a normal seating arrangement at a table may be employed by the main watercraft 11.

In accordance with another feature of the invention, a bridge, indicated generally by the reference numeral 27 is positioned so as to extend across the rear end of the berthing area 14. The bridge 27 is comprised of a pair of generally curved support posts 28 that are positioned at the outer peripheral edges of the deck portion 13 and which extend upwardly therefrom. A cross piece 29 spans these posts 28 and affords a cover for the riders 26 when seated on the covers 21. In addition, when a small watercraft is placed in the berthing area 14, the operator of the small watercraft may stand and either rest his back or his front side on the bridge 27 so as to assist in stabilization of his position.

A pair of guard rails 31 extend from the posts 28 forwardly along opposite sides of the berthing area 14 and along the sides of the passenger compartment 16. The guard rails 31 may also provide a way in which a rider of the small watercraft may pull the small watercraft into the berthing area 14, as also described in aforenoted co-pending application Ser. No. 722,599.

The bridge 29 may also provide a means whereby a bottle and implement carrier 32 (FIG. 3) may affixed thereto so as to hold implements for use by the riders 26 when seated in the sitting position adjacent the table 24.

Figure 7:
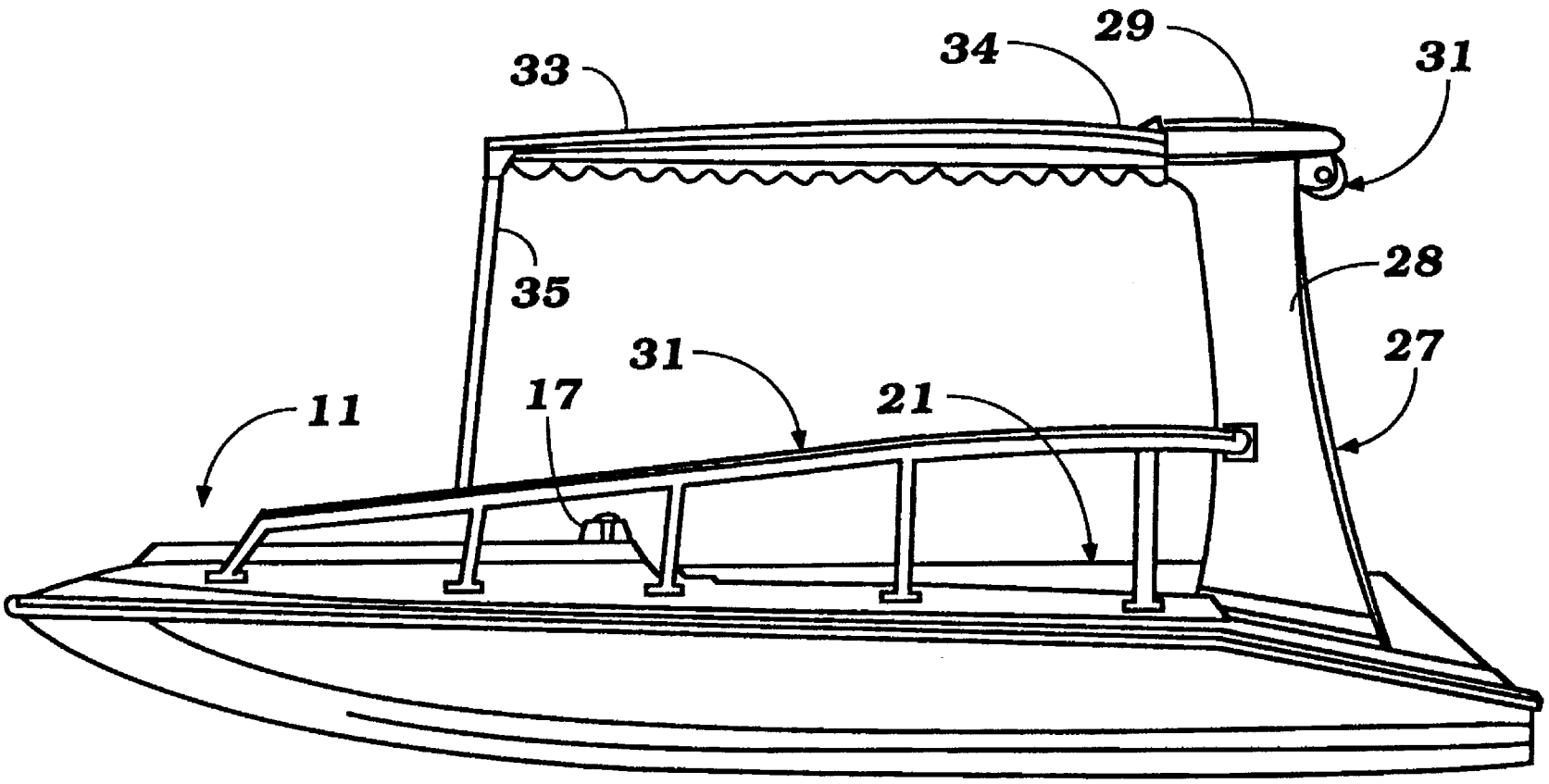
FIG. 7 is a side elevational view of the watercraft shown in the condition of FIG. 6.
Figure 8:
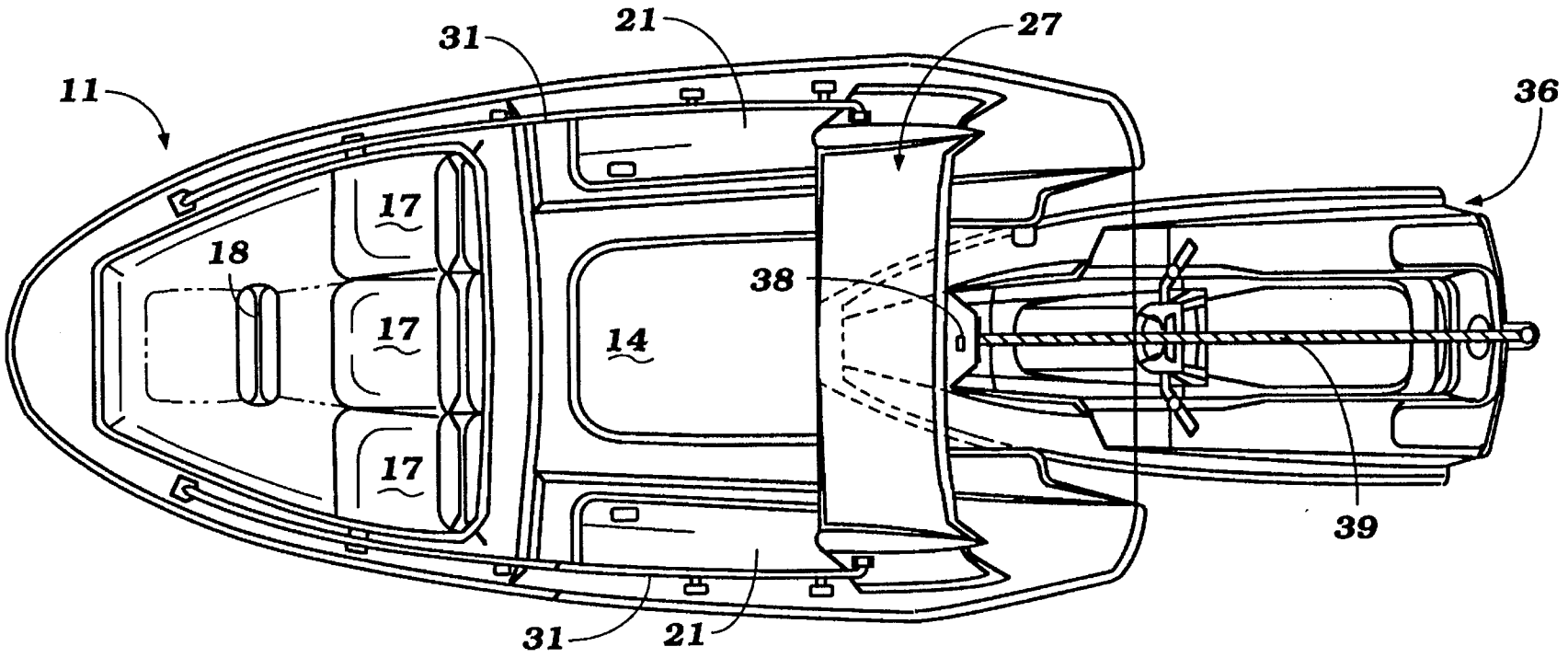
FIG. 8 is a top plan view, in part similar to FIGS. 1 and 6, and shows another embodiment of the invention or another accessory which can be employed with the previously described embodiments.
Figure 9:
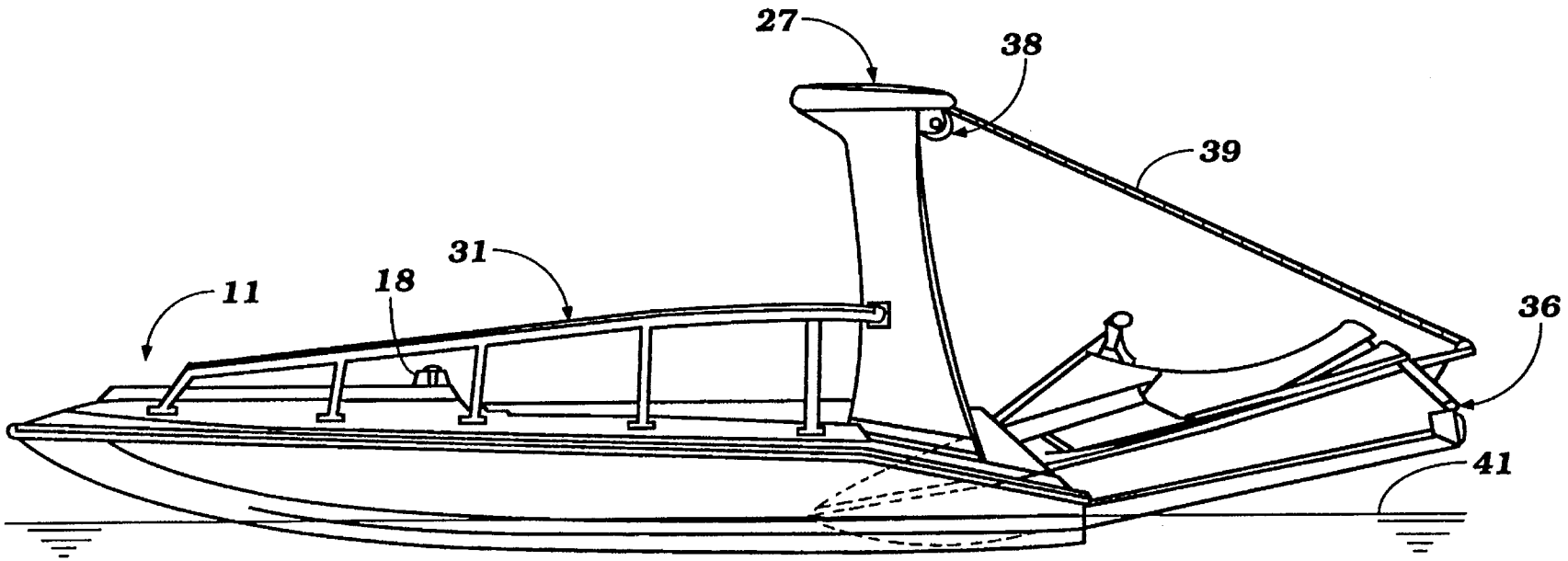
FIG. 9 is a side elevational view of this embodiment.

FIGS. 6 and 7 show another configuration which the watercraft 11 may take or alternatively another accessory for the watercraft. In this embodiment, there is provided a flexible roof 33 which may be folded or rolled and stored within one of the storage compartments 19 when not in use. This roof 33 is adapted to be attached to fasteners 34 carried by the cross piece 29 of the bridge 27 and extend forwardly for attachment to posts 35 that are received in suitable sockets (not shown) on opposite sides of the deck portion 13 around the riders area 16 so as to provide more complete cover for all riders in the watercraft 11. As may be seen in this embodiment, the small watercraft 36 is shown in phantom in the berthing area 14 and the cutout 37 in the lower wall for providing the water inlet opening to the water inlet 40 of the jet propulsion unit of the small watercraft 36 also appears.

In conjunction with such small watercraft 36, there are times when the small watercraft 36 is not employed to power the docking watercraft 11 or, in fact, times when the small watercraft 36 may not be driven. It may be desirable, however, to leave the small watercraft 36 partially in the body of water in which the watercraft is operating at this time. However, if the water inlet opening of the small watercraft 36 is left in the body of water then there is the possibility of encrustation occurring in the jet propulsion unit or other foreign material may become lodged in the jet propulsion unit of the small watercraft. Alsothe water inlet may be cleaned of debris if the small watercraft 36 is elevated within the berthing area 14.

In accordance with another feature of the invention, the bridge 28 is provided with a pulley 38 to which a rope 39 may be attached which can then be connected to the rear of the small watercraft 36 so as to elevate it out of the body of water, indicated by the line 41 so that its water inlet opening will be positioned above the water and water can therefore drain out of it and avoid such encrustation and also for cleaning. If desired, a manual or power operated winch (not shown) may be incorporated in conjunction with the pulley 38 so as to assist the elevation of the rear portion of the small watercraft. In addition, the pulley 38 may also be used at times to assist in drawing the small watercraft 36 into the berthing area 14.

It should be readily apparent description that the docking watercraft 11 permits a wider variety of uses for a small watercraft and the accommodation of a greater number of passengers when the small watercraft user may desire to carry additional passengers and more than can be accommodated by the small watercraft itself. In addition, the docking watercraft 11 may form a floating platform on which persons may enjoy themselves while the operator of the small watercraft 36 may drive it independently of the docking watercraft 11. Of course, the foregoing description is that of preferred forms of which the invention may take and various changes and modifications may be made without departing from the spirit and scope of the invention, as defined by the appended claims.

We claim:

1. A watercraft having a main hull defining a passenger's compartment and a berthing area open through the rear of said main hull and adapted to receive a smaller watercraft having a propulsion unit, said berthing area and said passenger compartment both being generally uncovered, said passengers compartment extended at least in part along one side of said berthing area said main hull being devoid of a propulsion device, said berthing area being configured and arranged for propulsion of said main hull by the smaller watercraft propulsion unit when received in said berthing area and when the smaller watercraft is still within the body of water in which said main hull is floating, and a bridge on said main hull extending at least in part over said betthing area, said bridge being formed by a pair of side posts extending upwardly on opposite sides of the berthing area and transversely outwardly of said passenger compartment and a cross piece fixed to the upper ends of said side posts and extending transversely across said berthing area, said bridge extending for a lesser length than the length of said berthing area and formed only at the rear portion of the berthing area.

2. A watercraft as set forth in claim 1 wherein the side posts are formed at the outer peripheral edges of the deck of the watercraft.

3. A watercraft as set forth in claim 2 wherein the berthing area is formed by at least a partial lower wall having an opening therein and wherein the smaller watercraft propulsion unit comprises a jet propulsion unit having a downwardly facing opening adapted to be aligned with said lower wall opening for drawing water into said jet propulsion unit when said smaller watercraft is in said berthing area.

4. A watercraft as set forth in claim 1 further including means carried by the bridge for lifting at least the rear portion of the smaller watercraft out of the body of water in which the watercraft is operating when at.least partially in the berthing area.

5. A watercraft as set forth in claim 4 wherein the means for lifting the smaller watercraft comprises at least a pulley carried by the bridge.

6. A watercraft as set forth in claim 5 wherein the berthing area is formed by at least a partial lower wall having an opening therein and wherein the smaller watercraft propulsion unit comprises a jet propulsion unit having a downwardly facing opening adapted to be aligned with said lower wall opening for drawing water into said jet propulsion unit when said smaller watercraft is in said berthing area.

7. A watercraft as set forth in claim 6 wherein the lift is adapted to raisethe water inlet opening of the jet propulsion unit of the smaller watercraft out of the body of water in which the watercraft is operating.

8. A watercraft as set forth in claim 1 wherein the main hull defines a pair of areas on opposite sides of the berthing area adapted to accommodate riders seated and facing each other with their feet in the berthing area without interference from the bridqe.

9. A watercraft as set forth in claim 8 further including storage compartments formed under the seat portions on the sides of the berthing area adapted to provide floatation for the hull and accommodate articles for storage.

10. A watercraft as set forth in claim 8 further including a detachable table affixed to the side portions of the hull and extending above the berthing area.

11. A watercraft as set forth in claim 10 further including storage compartments formed under the seat portions on the sides of the berthing area adapted to provide floatation for the hull and accommodate articles for storage, said table being formed of a knock down construction and being adapted to be received in the storage area.

12. A watercraft as set forth in claim 1 further including a canopy adapted to be affixed at its rear end to the bridge and extending forwardly therefrom over at least a portion of the passenqer compartment.

13. A watercraft as set forth in claim 12 wherein the passenger's compartment is formed at least partially forwardly of the berthing area.

14. A watercraft as set forth in claim 13 wherein the canopy is supported at its forward end by detachable posts.

15. A watercraft as set forth in claim 14 further including storage compartments formed under the seat portions on the sides of the berthing area adapted to provide floatation for the hull and accommodate articles for storage, said canopy and said detachable posts being knocked down for storage in at least one of said storage compartments.

16. A watercraft having a main hull defining a passenger compartment in a berthing area adapted to receive a smaller watercraft having a water jet propulsion unit, said main hull being devoid of a propulsion device, said berthing area being configured and arranged for propulsion of said main hull by the smaller watercraft water let propulsion unit when received in said berthing area, said berthing area being formed by at least a submerged partial lower wall having an opening therein for cooperation with an inlet opening to the water jet propulsion unit of the smaller watercraft for drawing water into the water jet propulsion unit when the smaller watercraft is in said berthing area, and hoist means adapted to raise the water inlet opening of the water jet propulsion unit of the smaller watercraft out of the body of water in which the watercraft is operating for storage while in the berthing area.

17. A watercraft as set forth in claim 16 wherein the hoist means are carried by a bridge that extends at least partially over the berthing area.

18. A watercraft having a main hull defining a passenger compartment at a berthing area adapted to receive a smaller watercraft having a propulsion unit, said main hull being devoid of a propulsion device, said berthing area being configured and arranged for propulsion of said main hull by said smaller watercraft propulsion unit when received in said berthing area, said main hull providing means on at least one side of said berthing area where a rider may sit with his feet in said berthing area, and a detachable table affixed to said main hull and extending over the rider's feet and within the berthing area when the rider is seated with his feet in the berthing area.

19. A watercraft as set forth in claim 18 wherein the means at the one side of the berthing area forms a storage compartment adapted to receive the table.

20. A watercraft as set forth in claim 18 wherein there are means for providing areas where riders may sit with their feet in the berthing area on opposite sides of the berthing area.

21. A watercraft as set forth in claim 20 further including a detachable table adapted to extend along the berthing area between the rider's seated with their feet in the berthing area.

22. A watercraft as set forth in claim 21 wherein the means providing the area for seating the riders covers a pair of storage areas and where the table is a knock down-table that is adapted to be received in at least one of the storage areas.

* * * * *